US008356926B1

(12) United States Patent
Sanders

(10) Patent No.: US 8,356,926 B1
(45) Date of Patent: Jan. 22, 2013

(54) INFLATABLE EXTERNALLY LIGHTED DECORATION

(76) Inventor: Harry E. Sanders, Asheboro, NC (US)

( * ) Notice: Subject to any disclaimer, the term of this patent is extended or adjusted under 35 U.S.C. 154(b) by 410 days.

(21) Appl. No.: 12/728,893

(22) Filed: Mar. 22, 2010

Related U.S. Application Data

(60) Provisional application No. 61/162,707, filed on Mar. 24, 2009.

(51) Int. Cl.
*H01R 33/00* (2006.01)

(52) U.S. Cl. ..... 362/653; 362/652; 362/654; 362/655; 362/656; 362/249.15; 362/249.16

(58) Field of Classification Search ..... 362/652–659, 362/249.13–249.19, 565–569
See application file for complete search history.

(56) References Cited

U.S. PATENT DOCUMENTS

| | | | | |
|---|---|---|---|---|
| 4,930,053 | A | 5/1990 | Vaught | 362/121 |
| 4,989,120 | A | 1/1991 | Davis et al. | 362/35 |
| 5,410,459 | A | 4/1995 | Yang | 362/249 |
| 5,772,312 | A | 6/1998 | Pihl-Niederman et al. | 362/249 |
| 5,947,581 | A | 9/1999 | Schrimmer et al. | 362/96 |
| 6,135,617 | A * | 10/2000 | Lai | 362/249.14 |
| 6,276,815 | B1 * | 8/2001 | Wu | 362/249.16 |
| 6,693,391 | B2 | 2/2004 | Ahroni | 315/185 |
| 6,832,842 | B2 | 12/2004 | Sullivan | 362/237 |
| 2009/0191787 | A1 | 7/2009 | Rubinstein | 446/220 |

* cited by examiner

*Primary Examiner* — William Carter
(74) *Attorney, Agent, or Firm* — MacCord Mason PLLC

(57) ABSTRACT

An inflatable externally lighted decoration includes an inflatable body and lights configured to externally illuminate the decoration. A plurality of attachment points on the body retain lights along the outer surface of the body. In some embodiments, the attachment points are wire retainers. A wire separator may be positioned on the body to fan the lights across the body. An attachment ring may be affixed to the body to suspend and/or retrieve the decoration from a structure.

18 Claims, 7 Drawing Sheets

INFLATABLE EXTERNALLY LIGHTED DECORATION

This application is based on, and claims priority to, provisional application having Ser. No. 61/162,707 having a filing date of Mar. 24, 2009 entitled INFLATABLE EXTERNALLY LIGHTED DECORATION.

FIELD OF THE TECHNOLOGY

The present disclosure relates generally to decorations, and more particularly to an externally lighted inflatable decoration.

BACKGROUND

A small, but growing group of private individuals decorate the trees on their properties with large, lighted spheres during the Christmas season. Often, these spheres are hand-made from chicken wire, or the like, with common Christmas lights. Typically these spheres include 100 to 200 of mini-lights of various colors and/or multicolored mini-lights. In some cases, entire neighborhoods have teamed together to make a wonderful lightshow as you drive through on residential streets.

While these light spheres are attractive, there are several problems associated with the chicken-wired spheres and their associated construction. For example, the spheres are made of chicken wire that must be cut to length, wound around into a cylinder and then shaped into a sphere. The common Christmas mini-lights are then wound around the chicken wire sphere and attached using twist ties, or other materials to attach the light sting(s) to the sphere. This endeavor requires considerable time and exposes the craftsman to injury from the sharp ends of the cut chicken wire. In addition, it is often difficult to construct and/or maintain a true spherical shape using chicken wire. Another problem is being able to find space to store these spheres during non-use, i.e. the off season or during transport between festivities, as the wired-spheres are not collapsible or easily packaged. Further, stocking the retail shelves with the chicken wire light spheres is problematic for many reasons. For instance, their bulky shapes require an inappropriate amount of shelf space, particularly during a busy holiday season, and packaging the chicken-wired spheres is difficult and expensive.

Therefore, Applicants desire an inflatable externally lighted decoration without the drawbacks presented by the traditional decoration strategies.

SUMMARY

In accordance with the present disclosure, a decoration externally illuminated with lights is provided for festive decoration. This disclosure provides an improved decoration that is convenient, efficient, and safe for the user, particularly when used during a holiday season, wedding, seasonal occasion, special event or for any other decorational purpose. This disclosure may also provide improved materials for assembling a decoration externally illuminated with lights, and a method thereof.

One embodiment of a decoration that is externally illuminated with a string of lights on a wire includes an inflatable body. The inflatable body may have an outer surface and a wire separator positioned on the outer surface of the body. Often, the wire separator may be polar in placement. Further, the inflatable body may be constructed of a translucent material, so as to allow light emitted from the lights to pass through the body. Typically, the wire separator helps to fan the lights along the outer surface of the body. In one embodiment, the wire separator is a ring adjustably positioned to the body. In another embodiment, the wire separator is attached to the body.

The decoration may also include an attachment ring, typically used to suspend the decoration from a structure, and/or for retrieval. Further, the decoration may include an electrical plug to an electrical energy source, wherein the attachment ring helps secure the electrical plug to the body. A plurality of wire retainers may also be affixed to the body. Typically, the wire retainers are adapted to retain the lights along the outer surface of the body. In some embodiments, the wire retainer includes a cavity to retain the wires or lights. In other embodiments, the wire retainer includes a slit to retain the wires or lights.

The decoration may include an inflatable body having an outer surface and a plurality of wire retainers attached on the outer surface of the body. In this embodiment, the wire retainers may be adapted to retain a segment of the string of lights along the outer surface of the body. Again, the body may be a translucent material to accentuate the lights through the body. Further, at least one attachment ring may be affixed to the body to suspend the decoration from a structure. The attachment ring may secure an electrical plug to an electrical energy source to the body. The wire retainer may include a cavity to retain the string of lights. Further, the wire retainer may include a slit to retain the wires or lights.

The decoration may also include a wire separator positioned on the body. In some embodiments, the wire separator fans the lights along the body, for example in a plurality of equidistant columns along the outer surface of the body. The wire separator may be a ring adjustably coupled to the body. Further, the wire separator may include one or more tabs. Typically, the wire separator may be heat welded, or otherwise fused, to the body, and includes a plurality of female openings and plurality of male couplings on each tab.

In further embodiments, an externally illuminated decoration may include an inflatable body, a string of lights, a plurality of wire retainers attached to the body, and a wire separator positioned on the body. The inflatable body may have an outer surface, and the body may be capable of a decoration shape and a storage shape. The wire retainers may retain the string of lights along the outer surface of the body. In particular embodiments, the wire retainers may retain the string of lights in a sequential order along the outer surface of the body when the string of lights is pulled taught, for example when the decoration is inflated into the decoration shape.

The wire separator may fan the string of lights along the outer surface of the body. In particular embodiments, the wire separator fans the string of lights into a plurality of equidistant columns along the outer surface of the body when the decoration is inflated into the decoration shape. The string of lights may be LED lights. Further, the decoration may include an attachment ring affixed to the body and configured to suspend the decoration from a structure.

The disclosure also includes materials for assembling a decoration externally illuminated with lights. The materials include an inflatable body having an outer surface, a plurality of wire retainers attached to the body, a wire separator capable of being positioned on the body. The materials may also include a jig for positioning the string of lights onto the body. The wire retainers may be capable of retaining the string of lights along the outer surface of the body. The wire separator may be capable of separating the string of lights along the outer surface of the body. The jig may be capable of positioning the string of lights onto the outer surface of the body. The materials may also include an attachment ring, typically used to suspend the decoration to/from a structure. Also, the lights in the materials may be a string of LED lights.

The above summary was intended to summarize certain embodiments of the present inventions. Embodiments will be set forth in the more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
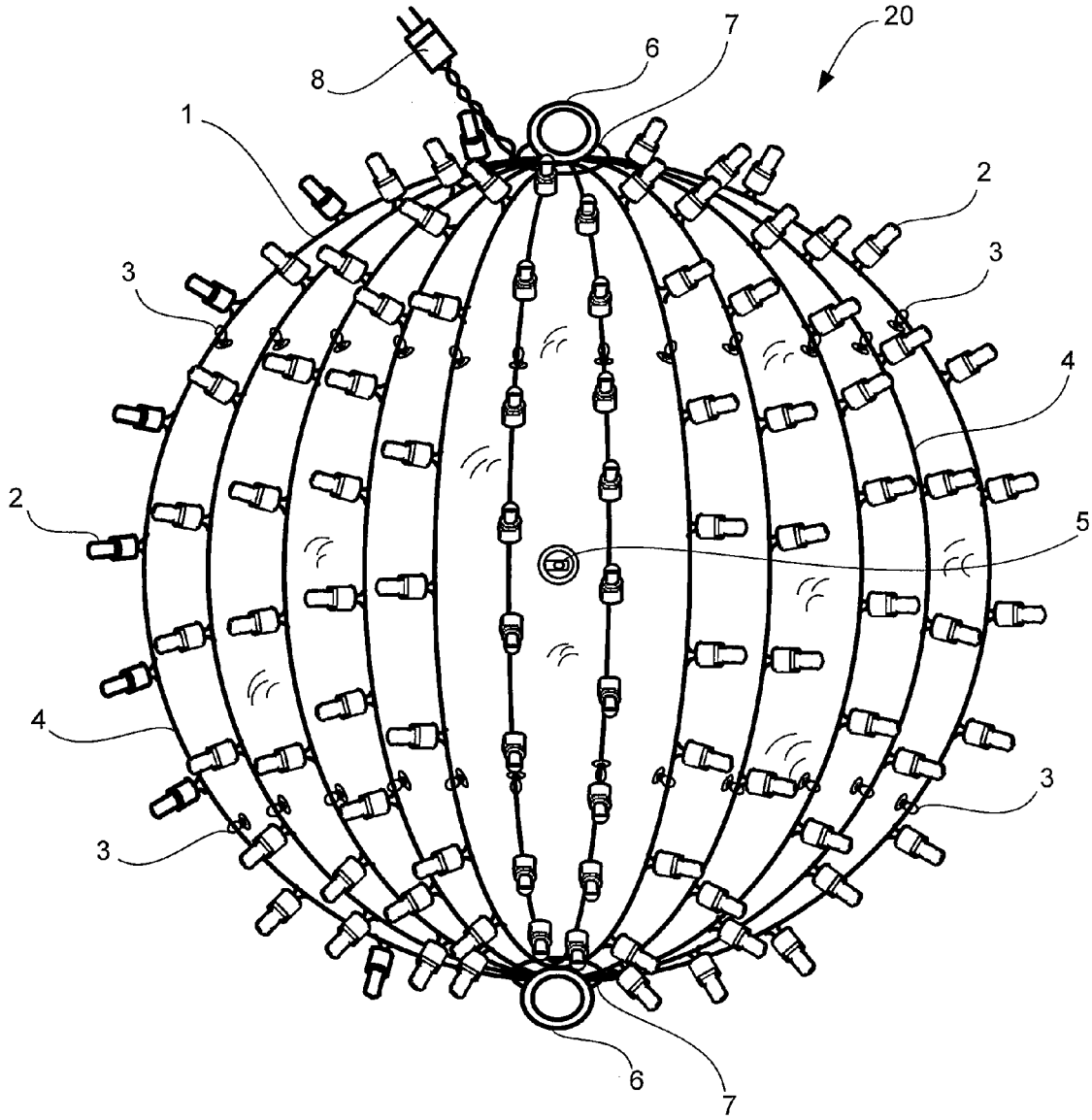
FIG. 1 is a perspective view of a decoration according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the inventions and are not intended to limit the disclosure or any invention thereto. As best seen in FIG. 1, a decoration 20 is shown embodied according to the present disclosure. Decoration 20 includes an inflatable body 1, a string of lights 4, and a plurality attachment points on the body 1, e.g. wire retainers 3 and/or a wire-separator 7, to secure the string of lights 4 on the body 1 to allow the decoration 20 to be externally illuminated. The lights are positioned on the outside of body 1.

As shown in FIG. 1, inflatable body 1 comprises an inflation valve 5, or similar air passage, to inflate and/or deflate the body 1. Such a valve can be any suitable valve, such as those used for inflatable beach balls. Inner tube valves may also be used.

The end of the wire with the male electrical plug 8 may be secured to the body 1. For example, the wire near the male electrical plug 8 is secured under the attachment ring 6. In another embodiment, the male electrical plug 8 is secured to the body 1 by placing the plug tab wire-separator 7, whereby the tab may be closed to secure the plug 8 to the body 1.

As seen in FIG. 1, body 1 may be spherical in an inflated shape; however, other embodiments of body 1 include a variety of shapes, styles and sizes. For example, the body 1 may be in the shape of a star, Christmas tree, candy cane, wreath, Christmas stocking, holiday characters (e.g. Santa Claus, Elves, Bunny Rabbits, etc), Easter egg, and the like when the body 1 is inflated into the decoration shape. The shape of the inflated body is not critical.

Body 1 is generally an inflatable, air-tight body constructed of a flexible material. Typically, the body's 1 material is clear or translucent of a thickness to remain flexible, but thick enough to resist puncture and tearing. For illustrative purposes only, one embodiment of body 1 is a PVC plastic. However, the body 1 may also comprise a variety of colors and/or non-translucent plastic-like materials, including transparent and/or opaque materials.

Figure 6:
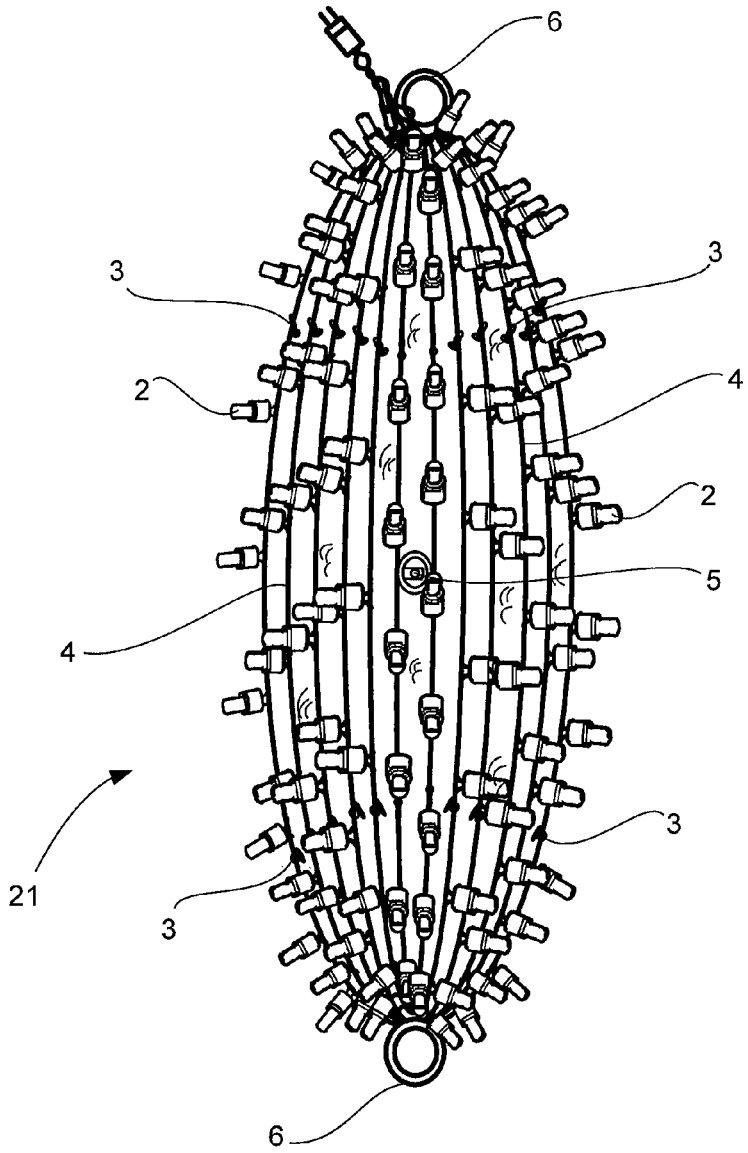
FIG. 6 is perspective view of a decoration in a deflated storage shape.

The body 1 has an outer surface. In particular embodiments, the inflatable air-tight body 1 may also have a central axis, where the outer surface is adapted to flexibly expand radially outwardly from a central axis into a decoration shape and flexibly collapse toward the central axis into a storage shape. One embodiment of the storage shape 21 is illustrated in FIG. 6. Other embodiments of body 1 include other configurations of styles, shapes, and materials.

FIG. 1 also shows attachment rings 6 positioned at the top and bottom of body 1 to provide for hanging the decoration 20, and for easy retrieval. However, the decoration may include a single, or more than two, attachment ring(s) 6 affixed to body 1 for enhanced versatility when suspending or retrieving the decoration 20 from a structure. For illustrative purposes only, a top and bottom attachment ring 6 may be used to align the body 1 between a structure, particularly to direct light substantially 360 degrees away from periphery of the body 1. Further, attachment ring 6 may be a carabiner.

Typically, a string, line, attachment clip or the like is connected to the attachment ring 6, which is used to suspend, hang or otherwise affix the decoration 20 from a structure, tree, building, line between two structures, or the like. Also a second string, line, etc. may be connected to the same or second attachment ring 6 for additional support, and/or to facilitate easy retrieval of the decoration 20.

As seen in FIG. 1, a plurality of wire retainers 3 are attached to the body 1 to retain the wire of the string lights 4 along the outer surface of body 1. The wire retainers 3 may be pre-affixed to body 1, or may be affixed to the body during installation. For example, the wire retainers may be glued, thermally fused, or the like, to body 1. Retainers 3 can also be used to bind lights 2 instead of or in addition to, the wire.

Figure 2A:
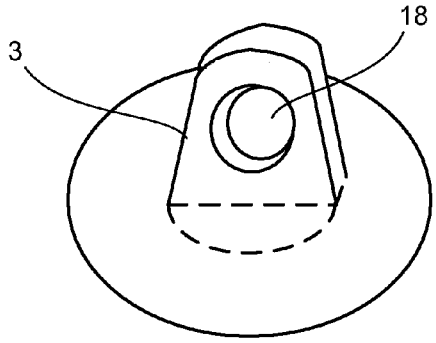
FIG. 2*a* is a perspective view of a wire retainer embodiment as shown in FIG. 1.

FIG. 2*a* illustrates one embodiment of wire retainers 3. Here, the wire retainer 3 includes an orifice or hole 18 to accept and fasten string of lights 4 to body 1. Typically, the wires and lights 4 are threaded through the cavity 18, and thus the wires and lights 4 are secured to the body 1 through the wire retainers 3.

Figure 2B:
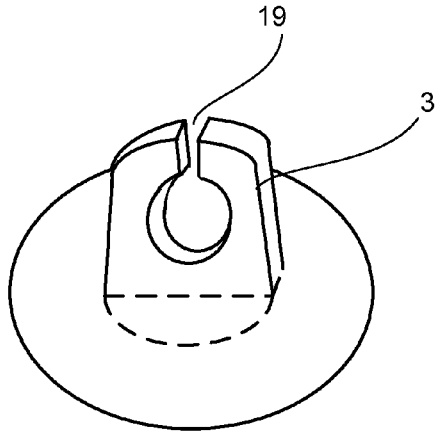
FIG. 2*b* is a perspective view of another wire retainer embodiment.
Figure 2C:
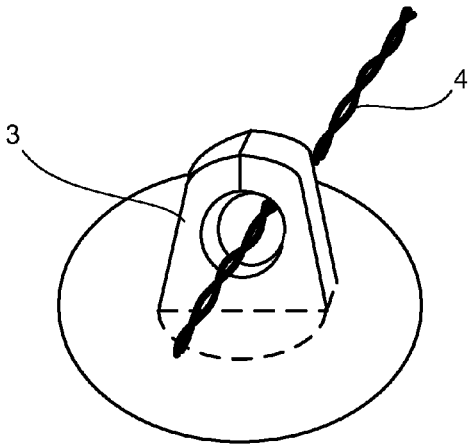
FIG. 2*c* is a perspective view the wire retainer embodiment as shown in FIG. 2*b* retaining a wire.

FIGS. 2*b* and 2*c* illustrate another embodiment of wire retainer 3, where the wire retainer 3 includes a slit 19. In this embodiment, the wire retainers 3 may be a resilient material, so that under normal conditions the retainer 3 is in a closed position, and force is required to open the retainer 3 to receive a wire. Typically, when the force is removed from the retainer 3, the resilient retainer closes and remains closed until further force is introduced. In this particular embodiment, the wire retainer 3 may be operably opened at slit 19 to accept and secure the wire with its lights 4 to body 1. The wire retainers 3 may also be positioned and arranged to retain a series of lights in a sequential order along the outer surface of body 1, particularly when the lights are pulled taught in the inflated, decoration shape as shown in FIG. 1. Various other retainer 3 embodiments are also possible. Non-sequential placement of wire and lights 4 is also within the scope of these inventions.

As seen in FIGS. 1, 3*a*-*d*, and 4*a*-4*b*, a wire-separator 7 may be located on the outer surface of body 1 to further secure the wires on body 1. Typically, the wire-separator 7 is positioned on body 1 to fan the wires across the outer surface of body 1. In particular embodiments, wire-separator 7 may be positioned substantially coaxially with on the central axis of body 1, and may retain the wires in a plurality of equidistant columns along the outer surface of body 1.

A power source, e.g. an appropriately rated electrical extension cord, may be attached to the support ring and the male electrical plug 8 may be inserted into the extension cord. Further, the power source, e.g. the extension cord, is plugged into an appropriately-rated electrical outlet to illuminate the decoration 20.

Figure 3A:
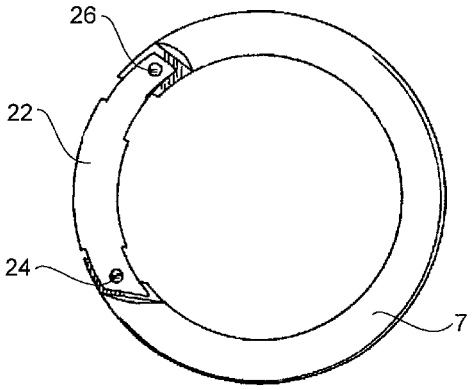
FIG. 3*a* is a top view of a wire separator embodiment as shown in FIG. 1.

FIG. 3*a* shows a ring embodiment of wire-separator 7. In this embodiment, the wire-separator 7 includes a sector 22 mounted on a pivot 24 and held closed by latch 24. Opening this sector 22 creates an opening to allow a series of wires onto the ring to separate the wires across the body 1, particularly when the body 1 is inflated into the decoration shape. The ring may be a carabiner or the like.

Figure 3B:
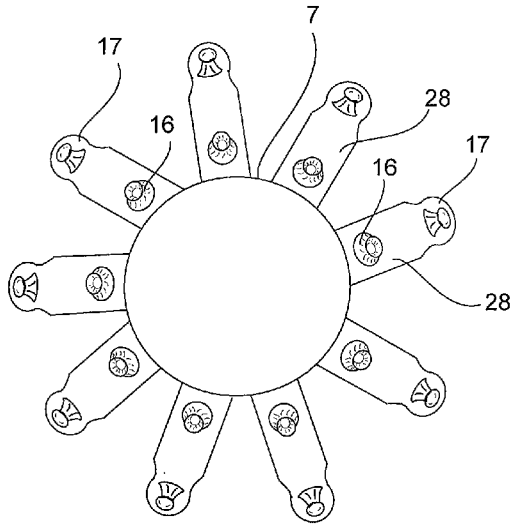
FIG. 3*b* is a top view of another wire separator embodiment.

FIG. 3*b* illustrates a tab embodiment of wire-separator 7. The tab wire-separator 7 may be glued, thermally fused or otherwise affixed to body 1. Further, the tab wire-separator 7 may be integrally affixed to body 1, or may removably attached to body 1 in a variety of locations along the outer surface for greater adjustability, such as with an adhesive. As shown in FIG. 3*b*, a plurality of tabs 28 project radically from the wire-separator 7, which itself may be a patch of material that can be bound to body 1. The tabs may include a female opening 16 on the inner section of the tab, and a male coupling 17 on the outer section of the tab. Typically, the outer section of the tab 28 is configured to fold over, or otherwise enclose a wire and hold it captured when the male coupling is engaged with the female opening 16. In particular embodiments, the male sections 17 may be selectively snapped into the female opening 16 to define loops to capture the wire along the outer surface of body 1. Of course, the positions of the male couplings and the female couplings can be reversed.

Figure 3C:
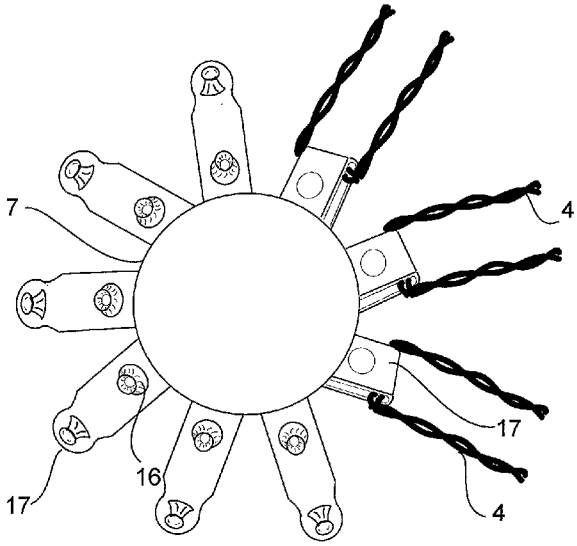
FIG. 3*c* is a top view of the wire separator embodiment as shown in FIG. 3*b*, with a portion of the tabs in the closed position to secure wires.
Figure 3D:
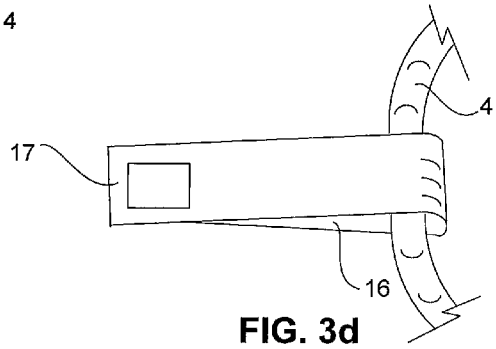
FIG. 3*d* is a perspective, isolated view of one of the closed tabs of the wire separator as shown in FIG. 3*c;*

FIG. 3*c* illustrates the tab wire-separator 7 with three of the tabs in the closed position to separate wires along the outer surface of body 1, with the remaining tabs in an open position. Further, FIG. 3*d* is an isolated view of one tab of the tab wire-separator 7, showing the detail of retaining a wire in the closed position. Here, the coupling outer section of the tab 17 is folded over the female section 16 to retain the wire. In other embodiments, the tabs of the wire-separator 7 can be a variety of shapes, styles, and fasteners for the convenience of separating and releasing strings of lights 4 along the outer surface of body 1, including simple hooks with catches to hold the wires in place. Any of the retainers and separators described herein can be considered attachment points.

Figure 4A:
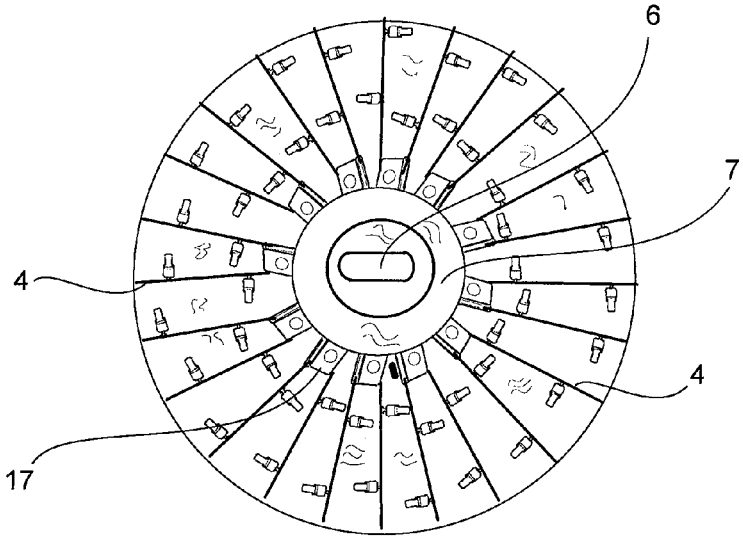
FIG. 4*a* is top view of the decoration, illustrating a ring wire separator embodiment.
Figure 4B:
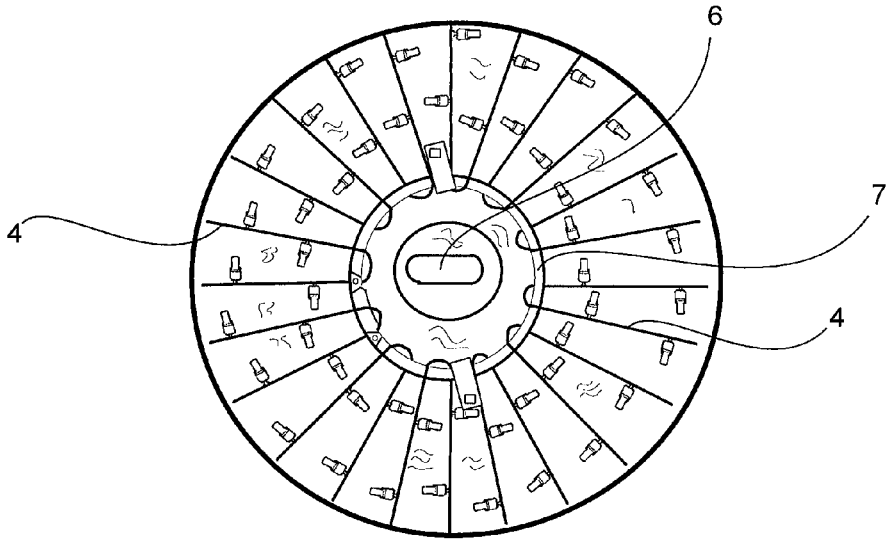
FIG. 4*b* is top view of the decoration, illustrating a snap tab wire separator embodiment.

FIG. 4*a* is a top view of decoration 20, illustrating the ring wire-separator embodiment 7 separating strings of wires in a decoration position. FIG. 4*b* is a top view of the decoration illustrating the tab wire-separator 7 embodiment separating strings of lights 4 in a decoration position.

The strings of lights 4 include, in addition to the wires to conduct electricity, a plurality of light bulbs 2 or light emitting diodes (LED's) and an electrical plug for insertion into a socket or extension cord. The lights can be incandescent or LED lights. However, because the LED embodiments consume significantly less power and produce significantly less heat than do the incandescents, more decorations 10 can be safely powered on a given rated circuit and given rated electrical extension cord with LED embodiments.

Figure 5:
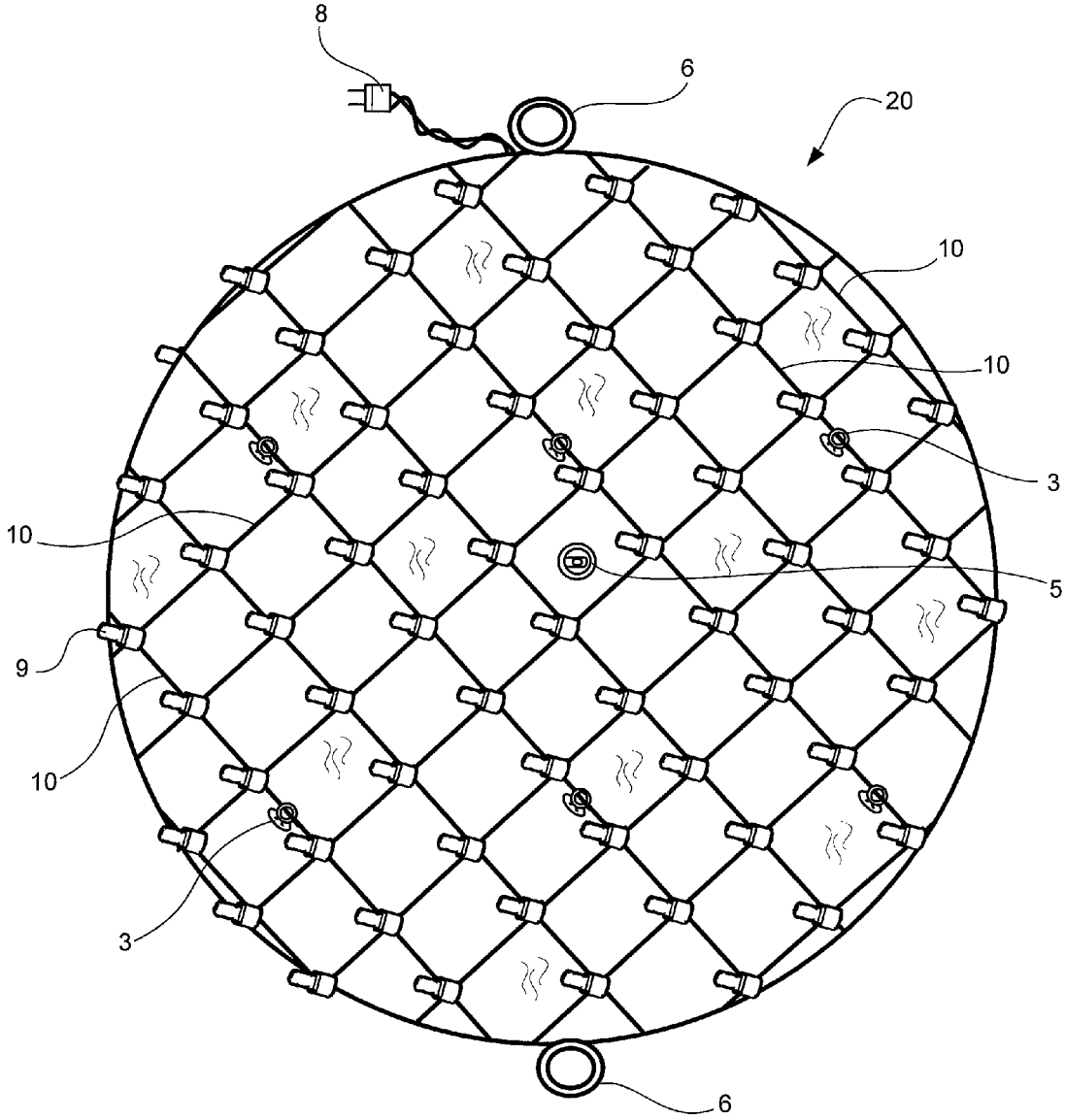
FIG. 5 is a perspective view of another embodiment of the decoration with net lights.

FIG. 5 illustrates a net 10 arrangement of lights as an alternative embodiment of decoration 20. Such net 10 configurations of the wires and lights are known. This embodiment comprises an inflatable shape with attachment points, e.g. wire retainers 3, positioned to hold incandescent or LED net lights in place instead of common light strings.

The strings or net 10 can have from as few as about 30 lights to as many as about 200 or more lights per string or net. Other embodiments of lights 4 or net lights 10 include other variations and arrangements of wires and light bulbs 2.

FIG. 6 shows the decoration 20 in a storage, deflated shape 21. In this particular embodiment, the wires and lights 4 remain affixed to the deflated body 1; however, other embodiments include a deflated shape where the string of lights 4, or net lights 10, can be fully, or partially, separated from the body 1.

This disclosure also includes materials for assembling a decoration 20 externally illuminated with lights 4. The materials may comprise an inflatable body 1, e.g. any of the body embodiments previously shown or described, a plurality of wire retainers 4 attached, or attachable, to the body 1, e.g. any of the wire retainers 4 shown or described, and a wire separator 7, e.g. any of the wire separators 7 previously shown or described, to separate the wires along the outer surface of the body 1. In some embodiments the separators can be eliminated and the wires held arrayed over the surface of the body 1 with retainers alone.

Figure 7:
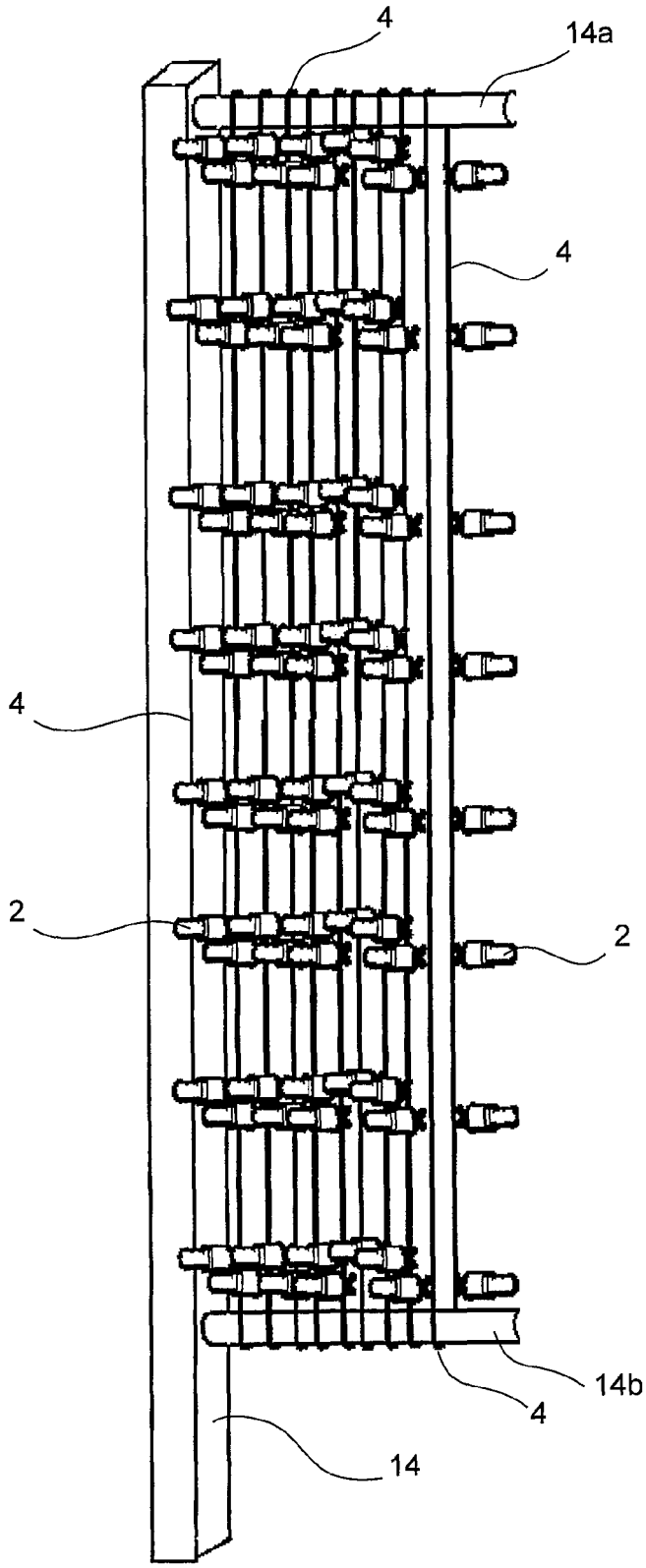
FIG. 7 is a perspective view of a string of lights positioned on a jig for assembling one embodiment of the decoration.

In use, embodiments of the decoration 20 are assembled by winding, or otherwise positioning, the string of lights 4 around the body 1, so as the string of lights 4 can be pulled taught when the body 1 is inflated into the decoration shape. In other embodiments, the string of lights 4 is positioned in a sequential order at a predetermined distance along the outer surface of body 1. The materials may also include a jig 14, as illustrated in FIG. 7. The string of lights may be wound around the jig 14 before being positioned on body 1. Often, the wires 4 may be wound around the top rung 14*a* and bottom 14*b* of the jig 14 in a sequential order at a predetermined distance. Then a separator 7 encircles the strings near each rung. The separators 7 are located at poles of the shape 1 and the wires are farmed over the body 1 and held in position with retainers 3. The separator of FIG. 3*a* is preferred in this embodiment. The string of lights 4 are pulled taught when the body 1 is inflated into the decoration shape.

Typically, the string of lights 4 is secured to the body 1 at one end, for example the top end, of the body 1. The end of the wire with the male electrical plug 8 may be secured to the body 1. For example, the male electrical plug 8 is secured under the attachment ring 6. In another embodiment, the male electrical plug 8 is secured to the body 1 by placing the plug 8 in the tab wire-separator 7, whereby the tab may be closed to secure the plug 8 to the body 1.

The lights 4 may be fastened to the surface of body 1 by securing the wires 4 to the wire retainers 3. In one embodiment, a string of lights 4 are threaded through the cavity 18 of the wire retainer 3. In another embodiment, the wires for the lights 4 are secured in the wire retainers 3 by opening the cavity 19 of the wire retainer 3, placing the wires into the cavity 19 and releasing the wire retainer 3 so it returns to the closed position.

The decoration 20 may be inflated, for example by pulling out on the inflation valve 5, squeezing the base of the inflation valve 5 and blowing into the tube until the desired level of inflation is achieved, e.g. into the decoration position. After the decoration 20 has obtained the desired shape, i.e. the decoration shape, the valve 5 is closed by releasing the valve 5, placing the cap over the inflation tube and pressing the cap onto the inflation tube. The valve 5 may be pushed inward to retract it to the inner surface of the body 1.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

I claim:

1. A decoration externally illuminated with lights comprising:

an inflatable body having an outer surface that has a plurality of wire separator attachment points comprising disks connected with the body and having a plurality of tabs, with female couplings and male couplings, and a collection of lights selected from the group consisting of a string of lights and a net of lights, the collection of lights being bound to the outer surface of the inflatable body by attachment at the attachment points, wherein the wire separators fan the lights along the outer surface of the body and wherein the tab can be folded on itself and secured by engagement of the female and male couplings and retaining an encircled portion of the collection of lights.

2. The decoration externally illuminated with lights as claimed in claim 1, wherein the attachment points include wire retainers attached on the outer surface of the body.

3. The decoration externally illuminated with lights as claimed in claim 2, wherein the wire retainer includes a cavity to retain the lights.

4. The decoration externally illuminated with lights as claimed in claim 2, wherein the wire retainer includes a slit to retain the lights.

5. The decoration externally illuminated with lights as claimed in claim 1, wherein the body is a transparent material to allow light to pass through the body.

6. The decoration externally illuminated with lights as claimed in claim 1, including an attachment ring affixed to the body to suspend the decoration from a structure.

7. The decoration externally illuminated with lights as claimed in claim 1, including an electrical plug for the light collection to enable connection to an electrical energy source, wherein an attachment ring secures the electrical plug to the body.

8. The decoration externally illuminated with lights as claimed in claim 1, wherein the wire separator is a ring adjustably positioned to the body.

9. An externally illuminated decoration, the decoration comprising:

an inflatable body having an outer surface, the body being capable of a decoration shape and a storage shape;

a string of lights;

a plurality of wire retainers attached to the body to retain the string of lights along the outer surface of the body; and a wire separator comprising disks connected with the body and having a plurality of tabs, with female couplings and male couplings, positioned on the body to separate the string of lights along the outer surface of the body, and wherein the tab can be folded on itself and secured by engagement of the female and male couplings and retaining an encircled portion of the string of lights.

10. The decoration according to claim 9, wherein the wire retainers are adapted to retain the lights of the string of lights in a sequential order along the outer surface of the body when the string of lights is pulled taught in the decoration shape.

11. The decoration according to claim 9, wherein the lights are net lights.

12. The decoration according to claim 9, including an attachment ring to suspend the decoration from a structure.

13. The decoration according to claim 9, wherein the wire separator separates the string of lights in a plurality of columns along the outer surface of the body in the decoration shape.

14. Materials for assembling a decoration externally illuminated with lights, the materials comprising:

an inflatable body having an outer surface; and a plurality of wire separator attachment points comprising disks having a plurality of tabs, with female couplings and male coupling, and capable of being attached to the body and retaining a collection of lights along the outer surface of the body by attachment at the attachment points, wherein the tabs are capable of being folded on itself and secured by engagement of the female and male couplings and retaining the collection of lights.

15. The materials according to claim 14, wherein the collection of lights is chosen from a string of lights and a net of lights.

16. The materials according to claim 15, wherein the collection of lights is a string of lights and further including a jig for positioning the string of lights for placement onto the outer surface of the body.

17. The materials according to claim 14, including an attachment ring to suspend the decoration to a structure.

18. The materials according to claim 14, wherein the wire separator is positioned on the body to separate the collection of lights along the outer surface of the body.

* * * * *

UNITED STATES PATENT AND TRADEMARK OFFICE

CERTIFICATE OF CORRECTION

PATENT NO. : 8,356,926 B1
APPLICATION NO. : 12/728893
DATED : January 22, 2013
INVENTOR(S) : Harr E. Sanders It is certified that error appears in the above-identified patent and that said Letters Patent is hereby corrected as shown below:

In Column 6, Line 52, farmed should be "fanned"

Signed and Sealed this
Nineteenth Day of March, 2013

Teresa Stanek Rea
*Acting Director of the United States Patent and Trademark Office*